US007017681B2

(12) United States Patent
Ivannikov et al.

(10) Patent No.: US 7,017,681 B2
(45) Date of Patent: Mar. 28, 2006

(54) DEVICE FOR PERFORMING HYDRODYNAMIC ACTION ON WELLBORE WALLS

(75) Inventors: Vladimir Ivanovich Ivannikov, Moscow (RU); Ivan Vladimirovich Ivannikov, Moscow (RU)

(73) Assignee: Whirlwind International B.V., Vries (NL)

( * ) Notice: Subject to any disclaimer, the term of this patent is extended or adjusted under 35 U.S.C. 154(b) by 173 days.

(21) Appl. No.: 10/399,346

(22) PCT Filed: Oct. 16, 2001

(86) PCT No.: PCT/RU01/00419

§ 371 (c)(1),
(2), (4) Date: Jul. 21, 2003

(87) PCT Pub. No.: WO02/33217

PCT Pub. Date: Apr. 25, 2002

(65) Prior Publication Data

US 2004/0011522 A1 Jan. 22, 2004

(30) Foreign Application Priority Data

Oct. 17, 2000 (RU) ..... 2000125924

(51) Int. Cl.
*E21B 1/00* (2006.01)

(52) U.S. Cl. ..... 175/56; 175/67; 175/297

(58) Field of Classification Search ..... 175/56, 175/67, 293, 296, 297; 166/249; 239/585.3
See application file for complete search history.

(56) References Cited

U.S. PATENT DOCUMENTS 3,416,613 A * 12/1968 Henderson ..... 175/296

(Continued)

FOREIGN PATENT DOCUMENTS

RU 2113630 6/1998

(Continued)

*Primary Examiner*—David Bagnell
*Assistant Examiner*—Matthew J. Smith
(74) *Attorney, Agent, or Firm*—Collard & Roe, P.C.

(57) ABSTRACT

The proposed invention relates to wellbore technologies and is intended to produce action on productive rock. Device for hydrodynamic action on wall of a well comprising a casing jointed with the pipe conduit directly or via a roller support and inside of which the mechanism for cavitating of flow of a liquid, mechanism for directing and splitting of the flow and mechanism for interrupting of the discharge jets are sequentially placed. The mechanism for cavitating of flow of a liquid is made in form of an auto-oscillating system. And specifically it can be made in a form of a ball with its diameter ratio to inner diameter of the casing of 0.9–0.98 and a limiter of axial motion; or a ball with its diameter ratio to inner diameter of the casing less than 0.9 and a limiter of axial motion in form of a coil spring lower end of which is rigidly connected to the casing and the upper end of which has a seat for the ball; or a cone the nose of which is directed counter flow, which cone is placed into a diffuser providing a clearance to let the liquid flowing and a freedom for the cone to move axially; or a butterfly valve freely rotating around transversely shaft and the halves of which are oppositely convex in respect of the rotation axis of said valve. The mechanism for interrupting of the discharge jets is made in form of the cylindrical roller bodies placed in the casing equidistantly or non-equidistantly by a separator wheel and resting on a ball working as both a roller support and a float valve. And the number of said cylindrical bodies is either (n+1) or (n−1) where (n) is a number of outlet orifices.

6 Claims, 6 Drawing Sheets

U.S. PATENT DOCUMENTS

| | | | | |
|---|---|---|---|---|
| 4,613,003 | A * | 9/1986 | Ruhle | 175/293 |
| 4,919,204 | A | 4/1990 | Baker et al. | |
| 5,190,114 | A * | 3/1993 | Walter | 175/56 |
| 5,361,830 | A * | 11/1994 | Wicks et al. | 175/56 |
| 5,505,262 | A | 4/1996 | Cobb | |
| 6,702,204 | B1 * | 3/2004 | Ivannikov et al. | 239/585.3 |
| 6,705,396 | B1 * | 3/2004 | Ivannikov et al. | 166/249 |
| 6,725,923 | B1 * | 4/2004 | Ivannikov et al. | 166/249 |
| 6,736,209 | B1 * | 5/2004 | Ivannikov et al. | 175/56 |

FOREIGN PATENT DOCUMENTS

| | | |
|---|---|---|
| RU | 2114280 | 6/1998 |
| RU | 2157446 | 10/2000 |
| SU | 953183 | 9/1982 |

* cited by examiner

DEVICE FOR PERFORMING HYDRODYNAMIC ACTION ON WELLBORE WALLS

CROSS REFERENCE TO RELATED APPLICATIONS

Applicant claims priority under 35 U.S.C. §119 of Russian Application No. 2000125924, filed: Oct. 17, 2000. Applicant also claims priority under 35 U.S.C. §365 of PCT/RU01/00419, filed: Oct. 16, 2001. The international application under PCT article 21(2) was not published in English.

FIELD OF USE

The proposed invention relates to wellbore technologies and is intended to produce action on the reservoir rock to intensify inflow rate of reservoir fluids into wellbore or the intake capacity of the reservoir rock, as appropriate, to decolmatate (liberate fine materials from) porous rock, to clean filters or tubes from dirt and various deposits, to create cavities in a wellbore wall via eroding of the rock by jets of liquid.

PRIOR ART

A device is known of a "roto-jet" type [U.S. Pat. No 4,919,204, 1990] which is suspended on a roller support at the lower end of a tubing or coil tubing string. It comprises a casing where the flow of a liquid pressurized by a pump splits into three or more jets ejecting into a well through semi tangential holes equipped with the nozzle inserts. Due to hydrodynamic head of the jets the wellbore wall or casing or lift tubing can be cleaned from dirt or deposits. The device rotates due to jets reaction.

One can refer to the following general shortcomings of this device:

1) The pressure head of the jet often is insufficient for effective cleaning of the tubes or wellbore wall;
2) The possibility is not provided to produce cavitation erosion which is the most effective method of the tube or wellbore wall cleaning.

A device is also known [U.S. Pat. No 5,505,262, 1996] to produce pulsating flow of liquid which device comprises a casing connected with a tubing or coil tubing string and inside of which a mechanism is placed to direct and split the flow. Said mechanism is made as a rolling ball which sequentially closes outlet orifices.

This device by principle of its action appears to be the most relevant technical solution to the proposed one and therefore is selected as a prototype. The main shortcomings of the prototype are the following:

1) The device, at its outlet, transforms the stationary flow into a pulsating flow that increases the hydraulic jetting effect of the jets action, but is some cases it still is insufficient to destroy corrosion products or extract the solid particles that close the fluid passes or destroy the rock at a wellbore wall;
2) The possibility is not provided to employ cavitational effect in interaction of jets with surface of tubes or wellbore wall;
3) The mechanism of interrupting the flow, which is made in a form of a ball element driven into motion by a vortex flow created above the ball, will not be capable to shift the ball closing the outlet orifice when it is stuck by differential pressure. It makes the device generally non-serviceable.

DESCRIPTION OF THE INVENTION

Goal of the proposed invention is providing of higher effectiveness of hydrodynamic action on the wellbore wall due to cavitation of the flow of liquid at elevated hydrostatic pressure by partially or fully breaking of the liquid flow continuity, and reduction of losses of hydraulic power of pumps to implement this process.

This goal is achieved due to that in the device, comprising a casing connected with or without a rotational support to a tubing inside of which a mechanism is placed to cause cavitation of the flow of liquid, a mechanism is provided for directing and splitting of the flow and a mechanism is provided for interrupting of the discharge jets. The said mechanisms are sequentially placed from the top of the device down, and the said mechanism for cavitating of the liquid flow is made in form of an auto-oscillating system.

In particular, the mechanism causing cavitation of the liquid flow can be made in a form of a ball with its diameter ratio to inner diameter of the casing of 0.9–0.98 and comprising a limiter of axial motion, or in form of a ball with its diameter ratio to inner diameter of the casing less than 0.9 and comprising a limiter of axial motion in form of a coil spring lower end of which is rigidly connected to the casing and the upper end of which has a seat for the ball. The cavitation mechanism can be made in form of a cone the nose of which is directed counter flow, which cone is placed into a diffuser providing a clearance to let the liquid flowing and having a freedom to move axially, or in form of a butterfly valve freely rotating around transversely axis and the halves of which are oppositely convex in respect of the rotation axis of said valve. Mechanism for interrupting of the discharge jets is made in form of the cylindrical roller bodies placed in the casing equidistantly or non-equidistantly by a separator wheel and resting on a ball working as both a roller support and a float valve. And the number of said cylindrical bodies is either (n+1) or (n−1) where (n) is a number of outlet orifices.

BRIEF DESCRIPTION OF DRAWINGS

The drawings illustrate various examples of embodiments of the proposed device and the device assemblies.

FIG. 1 shows the embodiment of the device comprising a casing 1 inside of which a cavitation mechanism is placed, which cavitation mechanism is made in form of a ball 2 placed on a roller or sliding support 3 which support is a limiter of axial motion of the ball.

FIG. 3 shows the embodiment of the device comprising a casing 1 inside of which a cavitation mechanism is placed, which cavitation mechanism is made in form of a ball 2 placed on a support which support is a limiter of axial motion of the ball and which is made in form of a spring 4. The lower end of the spring 4 is rigidly fixed in the casing 1 and the upper end has a seat 5 for the ball 2.

FIG. 5 shows the embodiment of the device comprising a casing 1 part of which is made in form of a diffuser 6 where a cone 7 is placed to form a cavitation mechanism. The cone 7 allows a clearance with a wall and has a stem 8 which can move in the stopper 9. The stopper 9 has holes 10. In spacing between the cone 7 and the stopper 9 a cavitation cavity 11 is formed.

FIG. 7 shows the embodiment of the device comprising a casing 1 inside of which a cavitation mechanism is placed, which cavitation mechanism is made in form of a butterfly valve 13 freely rotating around transversely shaft 12. The valve consists of two halves which are oppositely convex in respect of the rotation shaft 12. The ends of the shaft are fixed in the casing 1.

FIG. 9 shows the placement down flow of the cavitation mechanism of a mechanism for interrupting of the discharge jet. On a stationary sleeve 14 that is an extension of the casing 1, a casing 15 is placed concentrically. In the annulus between the casing 15 and sleeve 14 the cylindrical roller bodies 16 are placed separated by a separator wheel 17.

Figure 1:
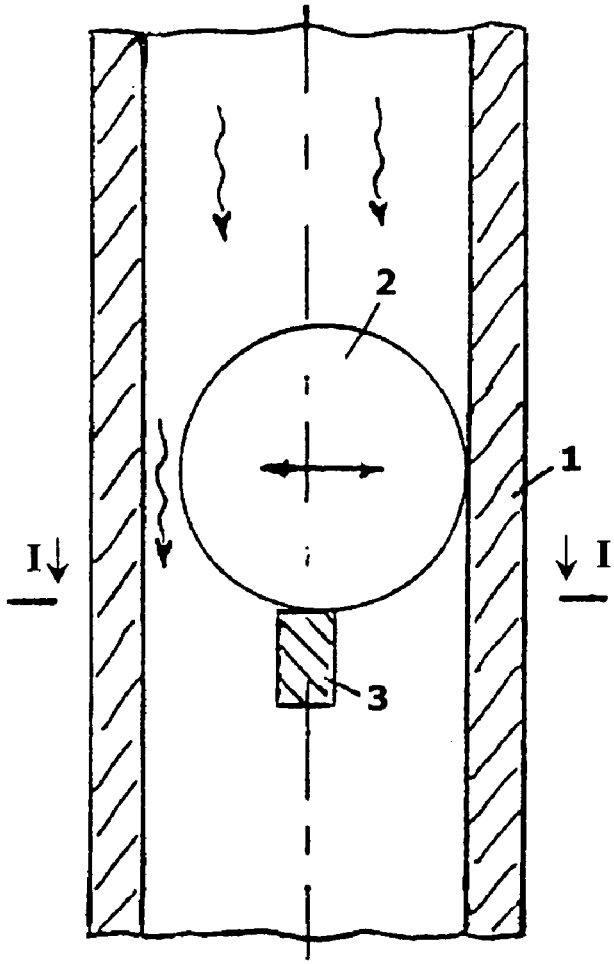
FIG. 1 shows an embodiment of the device of the invention representing a design of the cavitation mechanism operating in auto-oscillating mode.
Figure 2:
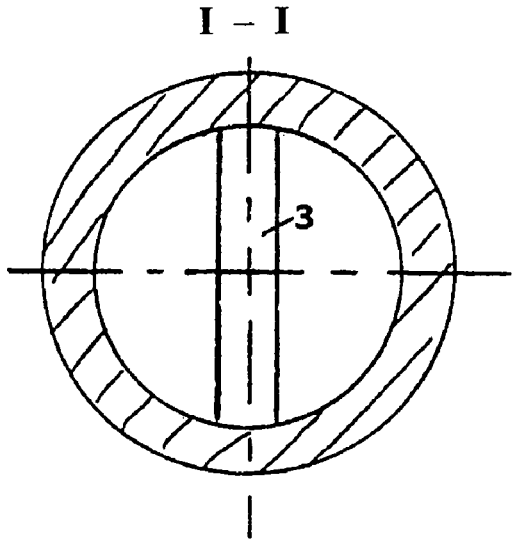
FIG. 2 shows a cross-section view of the device along line I—I of FIG. 1.

The cylindrical roller bodies 16 work as both the radial roller bearing and jets interrupter. Said cylindrical roller bodies 16 rest on a ball 18 which works as both the roller support and a float valve closing the outlet opening 19. In the casing 15 the tangential discharge jet holes 20 are made.

Figure 9:
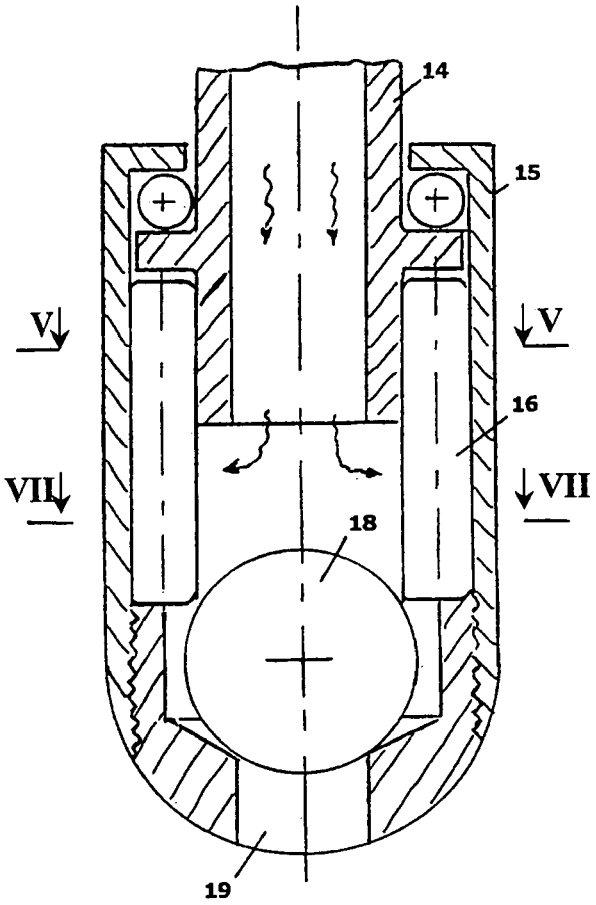
FIG. 9 shows a device of the invention where a mechanism for interrupting of the discharge lets is represented.
Figure 11:
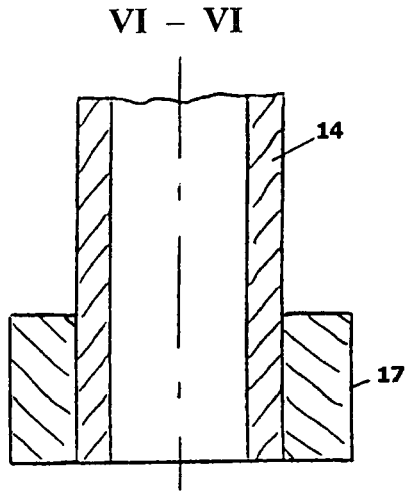
FIG. 11 shows a cross-section view of the device along line VI—VI of FIG. 10.
Figure 10:
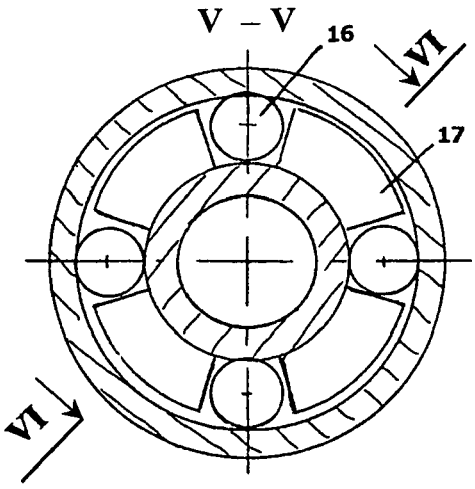
FIG. 10 shows a cross-section view of the device along line V—V of FIG. 9.
Figure 12:
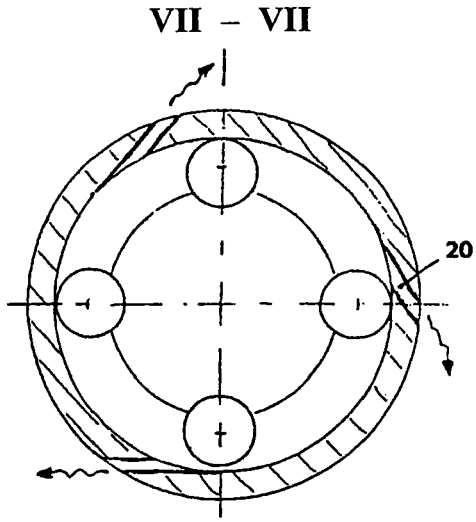
FIG. 12 shows a cross-section view of the device along line VII—VII of FIG. 9.
Figure 13:
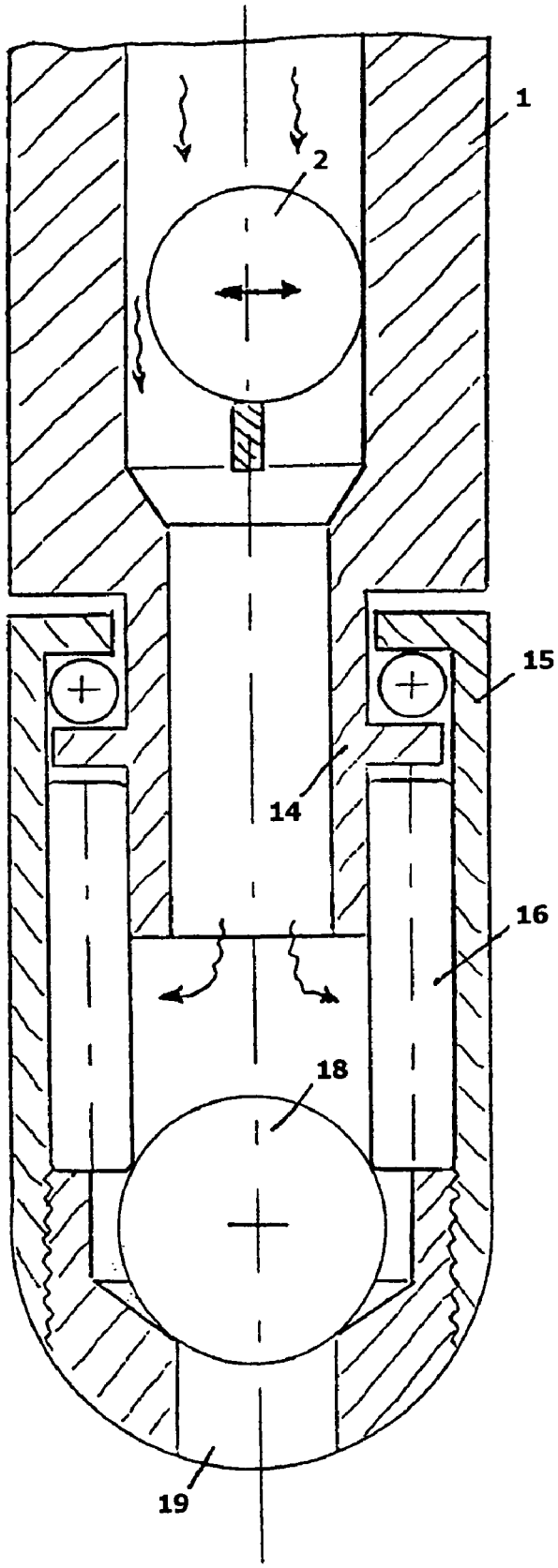
FIG. 13 shows an assembly of the device of the invention comprising one of possible cavitation mechanisms, mechanism for directing and splitting of the flow and the proposed mechanism for interrupting of the discharge jets.

FIG. 13 shows an assembly of the device comprising mechanism for cavitating of flow of a liquid, mechanism for directing and splitting of the flow and mechanism for interrupting of the discharge jets. The device consists of the casing 1 inside of which a cavitation mechanism is placed, which cavitation mechanism is made in form of a ball 2 placed on a support 3 as in the embodiment shown in the FIG. 1. End of the casing 1 is made in a form of a sleeve 14 on which a casing 15 is set. The sleeve 14, casing 15 and the cylindrical roller bodies 16 form the shown in the FIG. 9 mechanism for splitting and directing of the flow and also interrupting of the discharge jets.

VARIANTS OF THE EMBODIMENTS OF THE INVENTION

Device comprising mechanism for cavitating of the flow of liquid in form of a ball and a limiter of axial motion of the ball (FIG. 1) and known as rotocavitator work as follows.

Flow of liquid pumped into a well through a pipe (or string of pipes) flows around the ball 2 which ball is placed in a casing 1 jointed with the said pipe. Below the ball (down flow) a cavitational cavity is formed. Due to acceleration of the flow in clearance between the ball and wall of the casing 1 the pressure there decreases in accordance with the Bernoulli's law and the ball 2 moves in radial direction until it reaches the wall of the casing 1. In this moment a clearance becomes open at opposite side of the ball 2 and part of the cavitational cavity is cut and entrained by the flow. It causes splitting of that part of the cavitational cavity into smaller bubbles which bubbles are then carried by the fluid through the tangential side outlet orifices and implode when reach an obstacle (wall of the pipe or borehole). Due to reactive forces of jets the device, being connected to the pipe (string of pipes) via a roller support 3, rotates and thus the circular treatment of the pipe wall or borehole is provided. Axial travel of the device in the well is provided via standard running down or pulling out of the string of tubes.

Figure 3:
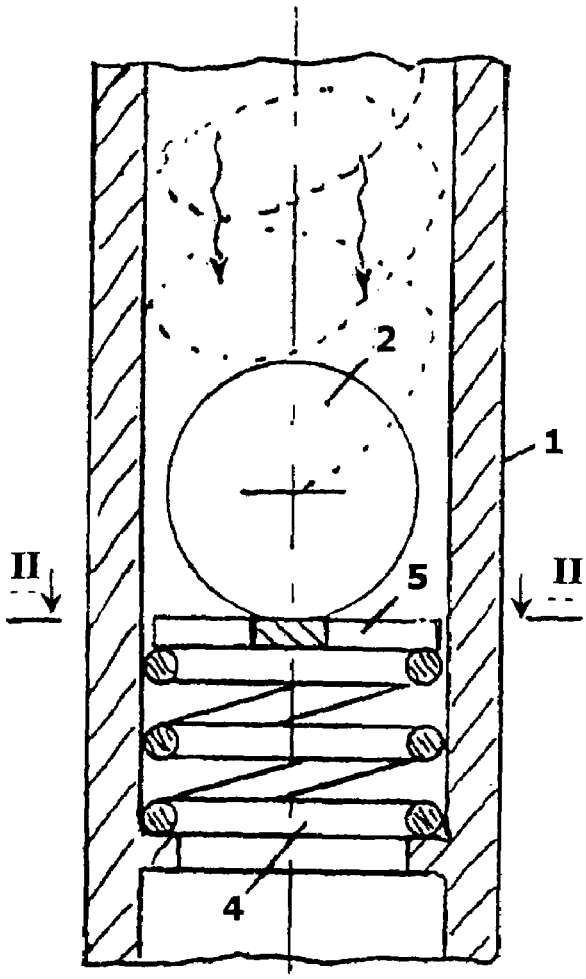
FIG. 3 shows an embodiment of the device of the invention representing a different design of the cavitation mechanism operating in auto-oscillating mode.
Figure 4:
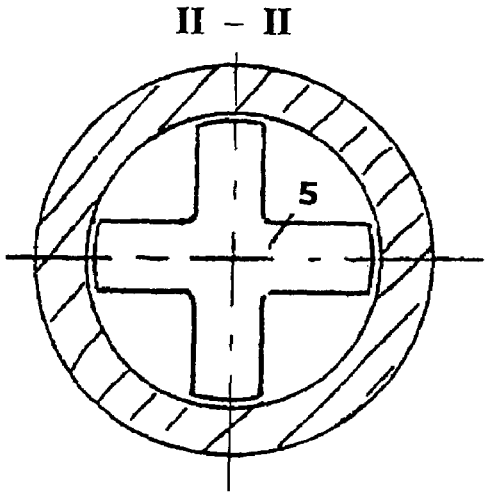
FIG. 4 shows a cross-section view of the device along line II—II of FIG. 3.

Device comprising mechanism for cavitating of the flow of liquid in form of a ball placed on a spring support (FIG. 3) works as follows.

The ball 2 with its diameter ratio to inner diameter of the casing less than 0.9 is flowed around by a flow of liquid and involved by it into circular motion (rolling along the inner wall of the casing) due to varying clearance between the ball and casing 1. Centrifugal force due to weight of the ball 2, conditions of flowing the ball 2 around by the down going flow and friction at the wall cause the ball moving up counter flow. However because of non-stationary nature of the flow the ball stalls then and is entrained by the flow downward. Spring 4 accepts and dampens the hit by the ball 2. When the ball hits the obstacle and stops, the cavitational cavity separates from it and is entrained by the flow. After that the process is repeated.

Figure 5:
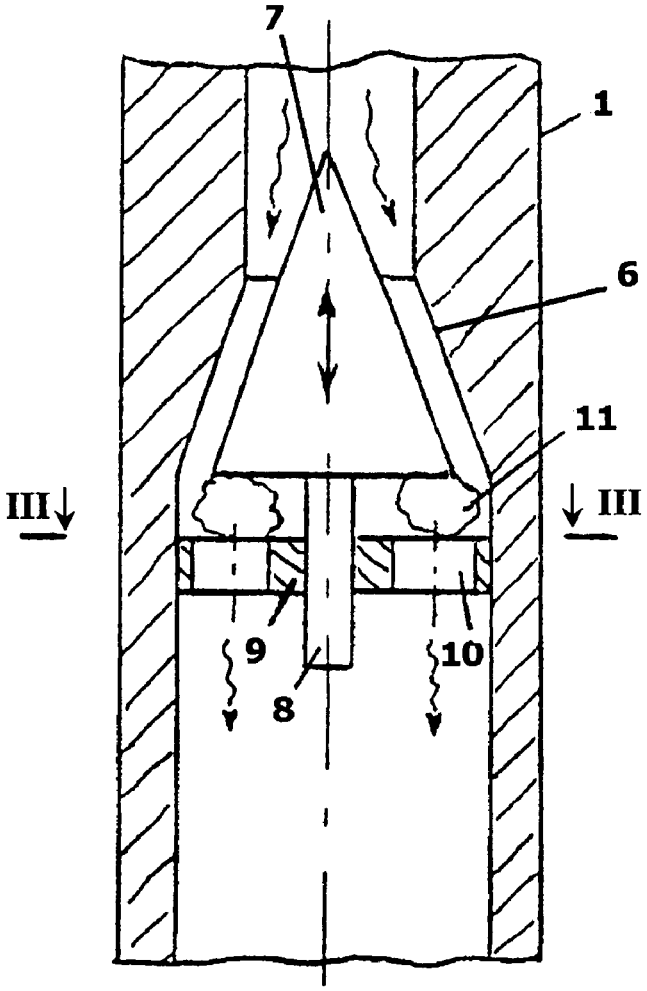
FIG. 5 shows an embodiment of the device of the invention representing another design of the cavitation mechanism operating in auto-oscillating mode.
Figure 6:
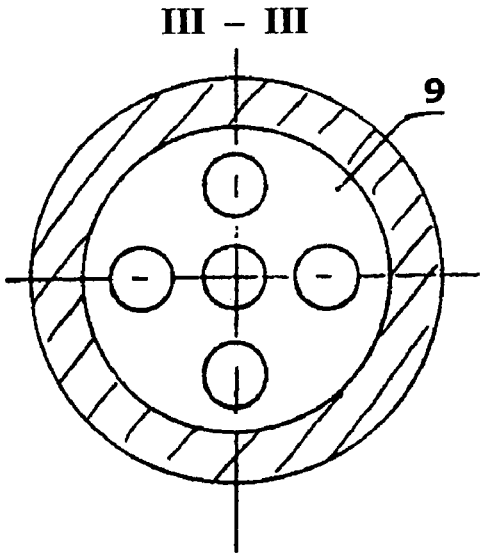
FIG. 6 shows a cross-section view of the device along line III—III of FIG. 5.

Device comprising mechanism for cavitating of the flow of liquid in form of a cone (FIG. 5) works as follows.

Flow of liquid pumped into a well through a pipe (or string of pipes) flows around a cone 7 placed into a diffuser 6 with a clearance. Below the cone a decompression zone and then the cavitation cavity 11 is formed. The cone 7 with a stem 8 having opportunity to move in the stopper 9 self-oscillates in axial direction. It provides separation of parts of the cavitation cavity 11 and entraining of them in form of bubbles through holes 10 in the stopper 9 and then through the tangential side outlet orifices into a well where they implode when reaching an obstacle.

Figure 7:
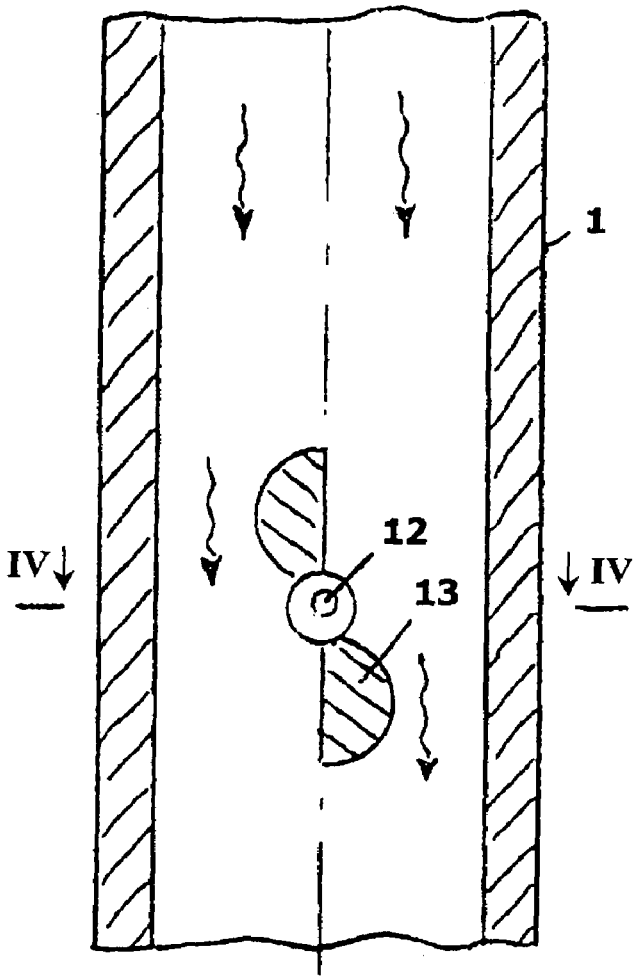
FIG. 7 shows an embodiment of the device of the invention representing a further design of the cavitation mechanism operating in auto-oscillating mode.
Figure 8:
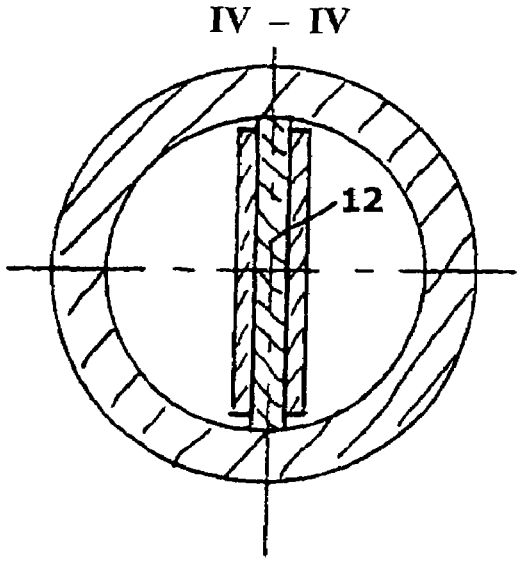
FIG. 8 shows a cross-section view of the device along line IV—IV of FIG. 7.

Device comprising mechanism for cavitating of the flow of liquid in form of a butterfly valve (FIG. 7) works as follows.

When liquid flows the butterfly valve 13 allowed to rotate on a transverse shaft 12 rigidly fixed in the casing 1 turns with its flat parallel to the direction of the flow. But the oppositely directed convex sides of the valve constrict the flow channel resulting in a torque causing periodic closing of the flow path by the butterfly valve. It results in breaking of the continuity of the flow and formation of a cavity which is entrained by the flow downward once the valve 13 turns by 90° and then goes through the tangential side outlet orifices into a well where they implode when reaching an obstacle.

Device comprising mechanism for interrupting of the discharge jet in form of cylindrical roller bodies (FIG. 9) works as follows.

The tangential discharge jets produce reactive rotation of the casing 15 which casing is concentrically placed on a sleeve 14 rigidly connected to the end of the casing 1. This sleeve joins the mechanism for interrupting of the discharge jet with the mechanism for cavitating of flow of liquid. The cylindrical roller bodies 16 are placed in the annulus between the rotating casing 15 and stationary sleeve 14 and are separated by a separator wheel 17 rigidly connected to the sleeve 14. These cylindrical roller bodies work as both the radial roller bearing and jets interrupter. Said cylindrical roller bodies 16 rest on a ball 18 which works as both the roller support and a float valve. The float valve is required to provide filling of the pipe (string of pipes) with the liquid when it runs into a well because otherwise the liquid can penetrate into it only through tangential discharge jet holes 20. But without the float valve it can happen that said discharge jet holes are plugged and the pipes in the string would be collapsed by hydrostatic pressure.

The known kinds of hydrodynamic action on the wall of a borehole are based on a hydraulic giant effect or effects of shock action of a pulsing jet on an obstacle including the cumulative effect. These interactions are realized in a homogeneous media (liquid) and require consuming of high hydraulic power to provide maximum possible speed of the discharge jet.

Combining the mechanism for cavitating of flow of liquid into device for hydrodynamic action on the wall of a borehole allows to obtain a two phase media—a gas-liquid system where gas bubbles exist during very short time because they implode due to hydrostatic pressure. And high speed of discharge jets allow them to leave the device casing and reach the obstacle (wall of a borehole or pipe) where the bubbles implode and produce required work. When the bubble implodes a local negative pressure is created upto 1000 MPa followed with a micro shock wave propagating into ambient liquid. It enables higher effectiveness of the cavitation jet to clean or eroding of the surface it interacts with. The imploding bubbles allow easily extract colmatants from porous or fractured rock: water drops, clay or sand particles. And circulation of liquid in the well transports them to the surface. The back micro shock wave produces micro cracks in the rock and thus opens new paths and improves permeability of the productive rock in bottom hole zone.

Problem in cavitating of a flow of liquid in wells, where hydrostatic pressure can be of 20–40 MPa, is how to produce and survive the breaks of continuity of the liquid in form of cavitation cavities under such conditions. Known methods are not capable to provide decompression in liquid sufficient to boil it adiabatically. The proposed device is capable to produce breaks of continuity of the liquid due to high flowing speed and periodic full or partial interrupting of the flow. In this case the extremely powerful inertial forces inherent to the moving liquid can be realized and fluid flow continuity can be implemented despite high hydrostatic pressure.

Break of a fluid flow continuity can be obtained also due to various hydraulic jars or other valve systems, but all of them require too high hydraulic power, their designs are rather complicated (and not durable) and high hydraulic shocks are generated in the pumped pipe. Also the repetition rate of such breaks is limited and it is not sufficient to maintain the continuous cavitation.

TECHNICAL APPLICABILITY

The proposed devices for hydrodynamic action on the wall of a borehole comprising the cavitating auto-oscillating devices are simple by their design and providing minimum pressure drop (not more than 3 MPa at pumping rate of up to ~30 liter/sec). In combination with interrupter of the discharge jet this device provides a pulsed regime of a circular action on the wall of a well.

Field tests of said devices in deep wells showed that due to decolmatation of the productive rock one can increase the oil intake flow by 2–3 times minimum and provide fast and effective cleaning of the lift and casing pipes from deposits and scale of different nature.

What is claimed is:

1. Device for hydrodynamic action on wall of a well comprising a casing and inside of which casing a mechanism for cavitating of flow of liquid, a mechanism for directing and splitting of the flow and for interrupting of discharge jets are sequentially placed in said order from the top of the device down wherein said mechanism for cavitating of flow of liquid is made in form of an auto-oscillating system; and said mechanism for directing and splitting of the flow and for interrupting of the discharge lets is made in the form of cylindrical roller bodies placed in the casing, separated and resting on a ball working both as a roller support and a float valve.

2. Device of claim 1, wherein said mechanism for cavitating of flow of a liquid is made in form of a cone the nose of which is directed counter flow, which cone is placed into a diffuser providing a clearance to let the liquid flowing and a freedom for the cone to move axially.

3. Device of claim 1, wherein said mechanism for cavitating of flow of a liquid is made in form of a butterfly valve freely rotating around a transversely shaft and the halves of which are oppositely convex in respect of the rotation axis of said valve.

4. Device of claim 1, wherein said mechanism, for interrupting of the discharge jets is made in form of the cylindrical roller bodies placed in the casing equidistantly or non-equidistantly by a separator wheel and the number of said cylindrical bodies is either (n+1) or (n−1) where (n) is a number of outlet orifices.

5. Device for hydrodynamic action on wall of a well comprising a casing and inside of which casing a mechanism for cavitating of flow of liquid, a mechanism for directing and splitting of the flow and for interrupting of discharge jets are sequentially placed in said order from the top of the device down wherein said mechanism for cavitating of flow of liquid is made in form of an auto-oscillating system; and wherein said mechanism for cavitating of flow of a liquid is made in form of a ball with its diameter ratio to inner diameter of the casing of 0.9–0.98 and comprises a limiter of axial motion of the ball.

6. Device for hydrodynamic action on wall of a well comprising a casing and inside of which casing a mechanism for cavitating of flow of liquid, a mechanism for directing and splitting of the flow and mechanism for interrupting of discharge jets are sequentially placed in said order from the top of the device down wherein said mechanism for cavitating of flow of liquid is made in form of an auto-oscillating system; and wherein said mechanism for cavitating of flow of a liquid is made in form of a ball with its diameter ratio to inner diameter of the casing less than 0.9 and comprises a limiter of axial motion in form of a coil spring lower end of which is rigidly connected to the casing and the upper end of which has a seat for the ball.

* * * * *